United States Patent [19]

Shuey

[11] 4,326,234

[45] Apr. 20, 1982

[54] ELECTRICALLY HELD POWER RELAY CIRCUIT WITH REDUCED POWER DISSIPATION

[75] Inventor: Kenneth C. Shuey, Cridersville, Ohio

[73] Assignee: Westinghouse Electric Corp., Pittsburgh, Pa.

[21] Appl. No.: 156,960

[22] Filed: Jun. 6, 1980

[51] Int. Cl.[3] ..... H01H 47/32

[52] U.S. Cl. ..... 361/154; 361/190

[58] Field of Search ..... 361/154, 152, 159, 190, 361/194

[56] References Cited

U.S. PATENT DOCUMENTS 3,896,346 7/1975 Ule ..... 361/154
3,909,681 9/1975 Campari et al. ..... 361/154
4,052,660 10/1977 Shuey ..... 323/303

FOREIGN PATENT DOCUMENTS 1428840 3/1976 United Kingdom .
1481496 7/1977 United Kingdom .
2015843 9/1979 United Kingdom .
2025183 1/1980 United Kingdom .
2032720 5/1980 United Kingdom .
1579391 11/1980 United Kingdom .

*Primary Examiner*—Harry E. Moose, Jr.
*Attorney, Agent, or Firm*—G. H. Telfer

[57] ABSTRACT

A relay coil circuit with a switching regulator for coil current to maintain, after closing, a sufficient holding current by the inductance of the coil acting as a current source without supply current.

2 Claims, 3 Drawing Figures

ELECTRICALLY HELD POWER RELAY CIRCUIT WITH REDUCED POWER DISSIPATION

BACKGROUND AND SUMMARY OF THE INVENTION

This invention is related to electrically held power relays in which a closed relay is to be provided with a reduced power dissipation.

Electrically held relays are operable to close electromagnetic contacts of a controlled circuit by application of a closing current of a given magnitude to the relay coil. Once the relay contacts are closed, the current through the coil required to hold the contacts closed is typically only about one-fourth of that required to achieve closing. Thus, if the same current is supplied from the power supply circuit to the coil, there will be power dissipation in the coil after closing that is not associated with any benefit. Particularly in applications where circuitry is arranged in a compact configuration and yet must be of high reliability, such as in aerospace applications, such power dissipation is desirably to be avoided. Power dissipation can be particularly serious at or above normal voltages as the power is the product of the input voltage and the relay coil current.

Attention has been previously given to relay coils and regulating circuitry for reducing the power dissipation.

FIG. 1 shows a representative example of known prior art in which a relay coil 10 is provided with an economizer circuit 12 for reducing operating current to hold in the relay contacts 14 after closing. The arrangement generally comprises a series circuit comprising the main relay coil 10, a so-called "tail switch" 16 and a voltage regulator. Electronic switch 18 controls the application of current to the circuit branch containing coil 10. The tail switch 16 is simply a pair of contacts electromagnetically actuated off the mechanism operated by the main coil 10 so that late in the travel of that mechanism, such as a plunger-type solenoid, and after sufficient closing current has been supplied to the main coil, the previously closed tail switch is opened. Then resistor R, connected in parallel with the tail switch 16 is in circuit with the main coil and reduces the current through the coil 10. Alternatively, or additionally, there may be a holding coil L connected across the tail switch 16 also serving to reduce steady-state power dissipation.

It is desired to eliminate the tail switch 16 as it is an additional mechanical element with some inherent reliability drawbacks or requirements for careful adjustment during production and assembly.

In accordance with the present invention a circuit is provided in which the inductance of the power relay coil is utilized as the choke of a switching current regulator. Means are provided in the regulating circuitry for sensing the current in the relay coil and comparing it with a reference so that, upon achievement of the required closing current level, supply current is no longer supplied to the relay coil but its required holding current is maintained by the inductance of the coil itself and upon decay of the relay current down to near the holding current minimum level, the supply current is switched back into the relay coil for a brief period.

The arrangement preferably includes transistor or solid-state switches and a voltage comparator for maintaining high reliability and also includes an additional transistor means for speeding up the reduction of coil current upon removal of the DC supply to result in fast opening of the relay.

Arrangements in accordance with this invention can reduce steady-state power dissipation over prior art such as that of FIG. 1 by an order of magnitude or more as well as provide greater reliability by elimination of the mechanical tail switch.

DESCRIPTION OF THE PREFERRED EMBODIMENTS

Figure 2:
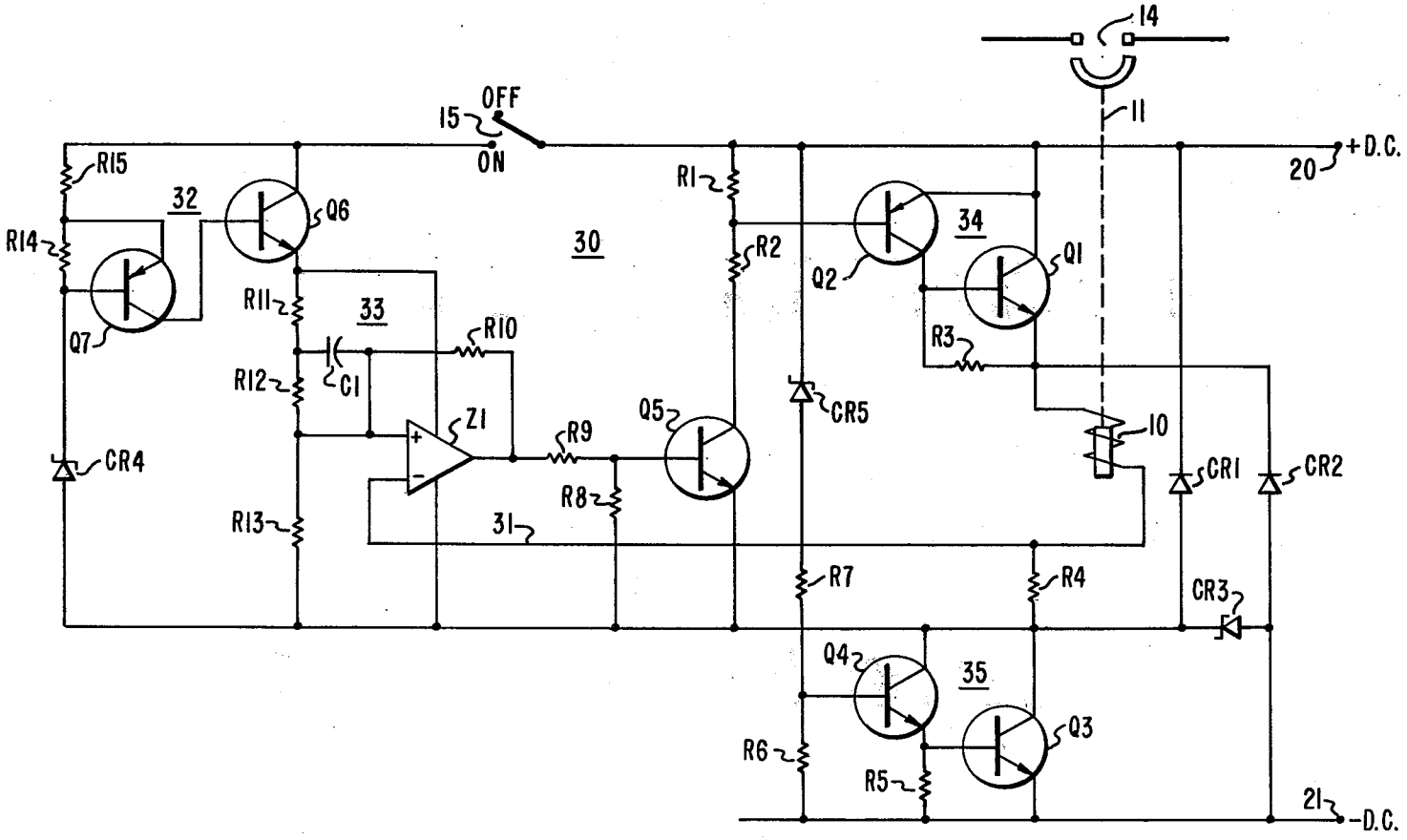
FIG. 2 is a circuit schematic of an improved power relay circuit in accordance with one embodiment of the present invention.

Referring to FIG. 2, a relay circuit in accordance with the present invention is shown which generally comprises a relay coil 10 associated with a mechanism 11 closing contacts 14 in a controlled circuit and which is in a series circuit path between a pair of DC input voltage terminals 20, 21. The relay coil 10 is of the type which is operable to close the contacts 14 of the controlled circuit by application of a closing current of at least a first magnitude and operable, after closing, to hold the contacts closed by application of a holding current of at least a second magnitude, less than the first magnitude. Associated with the relay coil is regulating circuitry 30 for achieving the initially required closing current and for thereafter maintaining a reduced level of current, but sufficient for holding the relay closed, until the DC supply at terminals 20 and 21 is interrupted. ON-OFF control switch 15 controls overall operation of the relay coil circuit.

The regulating circuitry 30 generally includes means for sensing the current in the coil 10, which in this example comprises the resistor R4 across which a voltage is developed representative of coil current. R4 is a small valued resistor, such as one-half ohm, so that its own power dissipation is minimal. A means for comparing sensed coil current with a reference of predetermined magnitude is provided that includes a voltage comparator Z1 that receives as one input the voltage from the resistor R4 appearing on line 31. Comparator Z1 also receives as another input a voltage that is provided by the DC supply in conjunction with a gated series voltage regulator 32 and a resistive voltage divider 33. The output of the comparator Z1 is thus indicative of the relation of the coil current 10 at a given time to the reference which is set in accordance with the required current level for maintaining the relay closed.

Additional key components include means for switching the coil current on and off. That is, such means is for removing supplied current from and bypassing the coil during periods in which the contacts 14 are closed and the coil holding current is of sufficient magnitude and for restoring supplied current when the coil current reaches a level down close to the minimum required holding current.

First and second transistor switch means 34 and 35 are employed in the series circuit of the relay coil between the terminals 20 and 21 for the desired switching functions in this embodiment. The first transistor means 34 comprising transistors Q1 and Q2 is required to be ON in order for the relay coil to receive power from the supply. The second transistor means 35 is on the low-voltage side of the relay coil in relaton to the supply and serves a function to be described in connection with the initial turning on of the relay coil and also in expediting the reduction of current in the coil to result in relay opening upon removal of supply current.

Assuming a time when the input voltage is present initially, i.e., switch 15 is closed and voltage is present at terminals 20 and 21, transistors Q3 and Q4 are turned on because the voltage is sufficient to apply base drive to Q4 through zener diode CR5 and resistor R7 so that this positive base drive turns on the NPN transistor combination of Q3 and Q4.

At this time a relatively low voltage appears across R4 and the comparator Z1 sees a wide difference between its inputs that provides drive current initially to Q5 which then energizes or drives the combination of Q1 and Q2 which delivers current to the main relay coil 10 to achieve closing. That is, when Q1 and Q2 are fully on and saturated, power is delivered to the coil 10 from the DC supply. When the voltage across the current shunt R4 reaches a level set by the divider network 33 comprising R10, R11, R12 and R13, comparator Z1 removes drive to Q1 and Q2 and effectively disconnects the relay coil 10 from the DC supply. Now the relay coil 10 begins acting as a current source working into the low-voltage circuit of Q3, Q4, and CR2, the diode connected from the negative DC terminal to the high-voltage side of the relay coil. The low commutation voltage keeps the rate of change of discharge current low. When the coil current reduces to the level set by the voltage divider, in which resistor R10 determines switching hysteresis, Z1 switches Q1 and Q2 on to repeat the cycle.

Figure 1:
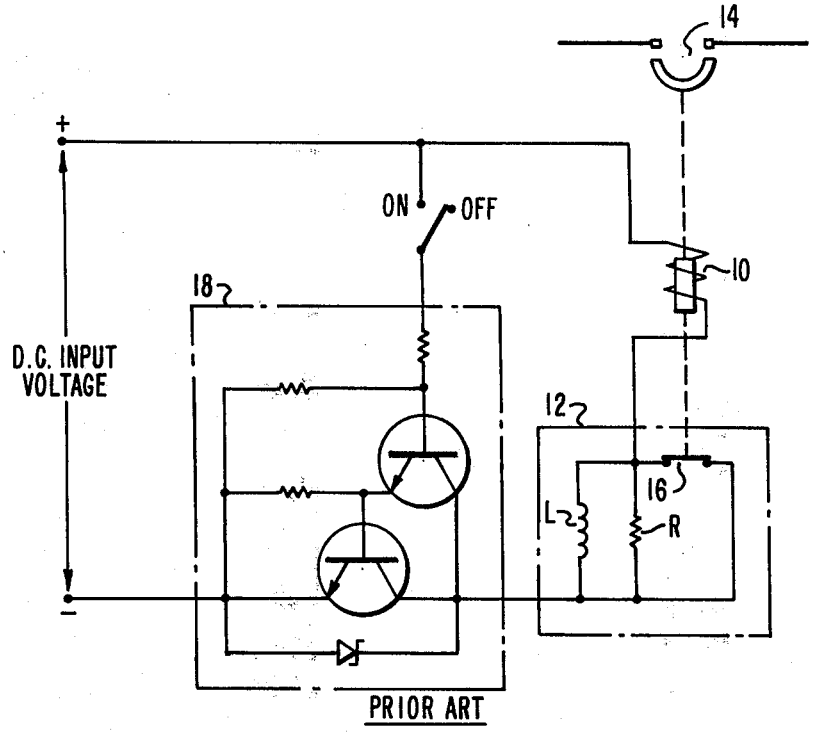
FIG. 1 is a circuit schematic of a power relay with an economizer circuit in accordance with the prior art.
Figure 3:
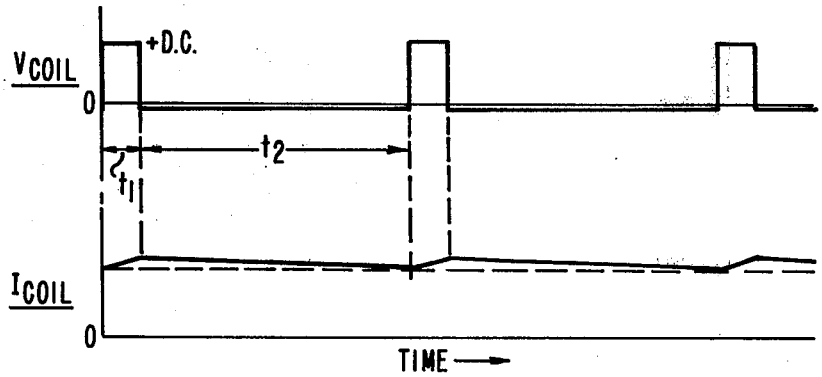
FIG. 3 is a set of voltage and current characteristics generally illustrating the operation of circuits in accordance with the present invention.

FIG. 3 shows the resultant coil voltage and current waveforms for the circuit illustrating those periods of time $t_1$ in which Q1 and Q2 are on so that relatively high voltage appears across the coil and the current builds up. During intervening relatively longer periods $t_2$ the coil current gradually decays and upon reaching the predetermined control level $I_H$, Q1 and Q2 are again energized so that the current builds up again.

Components Q3, Q4, CR3 and their associated resistors R5 and R6 provide fast dropout time when the DC voltage is removed. That is, upon no voltage being applied to the DC input terminals, as by opening of an ON/OFF switch somewhere in the circuit, Q3 and Q4 come out of saturation and the commutation path for the relay coil is through CR3 and CR2. This increase in commutation voltage causes a high rate of change of current and a resultant fast trip time in which the relay coil contacts are rapidly opened.

The gated series voltage regulator 32 comprising components Q6, Q7, R14, R15, CR4, and C1 operates to step-apply regulated voltage to the divider network 33 and comparator Z1. The step-applied voltage causes C1 to bypass R12 on turn-on and create a high level of current reference for comparator Z1. This initial high level allows the relay closing current to be achieved before regulation starts. As C1 charges, the reference decreases so that under steady-stage conditions the previously mentioned current reference is achieved. The circuit time constant is set to exceed the maximum closing time of the relay in application. The voltage regulator of the circuit including transistors Q6 and Q7 is generally in accordance with the teachings of Shuey U.S. Pat. No. 4,052,660, Oct. 4, 1977, which is herein incorporated by reference. This patent describes circuitry which provides voltage regulation with gating means for the output to remain off until the desired regulation level is reached. The gated series voltage regulator 32 differs from the specific embodiment of U.S. Pat. No. 4,052,660 to minimize the number of components. Regulator 32 does not require a resistor connected between terminal 20 and the collector of $Q_6$ because of the low level of power dissipation in $Q_6$. In the embodiment of the patent, such a resistor was employed to reduce the power in the corresponding transistor. However, in some instances it will be desirable to use a regulator as shown in the patent for better continuity of circuit performance.

By way of further example, the following table identifies components suitably used in the circuit of FIG. 2; the apparatus contemplated being one in which the DC supply voltage is 28 volts between terminals 20 and 21, the required relay closing current is 4 amperes D.C., and the required relay holding current is 0.6 amperes D.C. In operation such circuit exhibits on-times ($t_1$ of FIG. 3) of approximately 0.36 millisec., commutation times ($t_2$ of FIG. 3) of approximately 6.7 millisec., and a continuous power dissipation of approximately 1.72 watts.

TABLE

| FIG. 2 Component | Identification |
|---|---|
| Transistors Q1 and Q3 | 2N3773 |
| Transistors Q2 and Q7 | 2N2904 |
| Transistors Q4, Q6 and Q5 | 2N2219A |
| Diodes CR1 and CR2 | 1N4002 |
| Zener diode CR3 | 46 v., 400 mw. |
| Zener diode CR4 | 15 v., 400 mw. |
| Zener diode CR5 | 10 v., 400 mw. |
| Capacitor C1 | 0.1 microf., 37 v., tantalum |
| Comparator Z1 | Lm 124 (only one-fourth of quad unit required) |
| Resistors R1, R6 and R8 | $1 \times 10^3$ ohms, ¼w. cc. |
| Resistor R2 | $1.8 \times 10^3$ ohms, ½w. cc. |
| Resistors R3 and R5 | 51 ohms, ¼w. cc. |
| Resistor R7 | $3 \times 10^3$ ohms, ½w. cc. |
| Resistors R9, R13 | $10 \times 10^3$ ohms, ½w. cc. |
| Resistor R10 | $5 \times 10^6$ ohms, ½w. cc. |
| Resistor R11 | $40 \times 10^3$ ohms, ½w. cc. |
| Resistor R12 | $450 \times 10^3$ ohms, ½w. cc. |
| Resistor R14 | $43 \times 10^3$ ohms, ½w. cc. |
| Resistor R15 | $13 \times 10^3$ ohms, ½w. cc. |
| Resistor R4 | 0.5 ohms, 1w. ww. |

Thus, there is provided a current regulator utilizing the coil of an electrically held power relay as the energy storage element for maintenance of holding current with a reduction in steady-state power dissipation by an order of magnitude or more compared with prior art techniques. Additionally, the solid-state circuitry in accordance with this invention permits elimination of mechanical tail switches and their required adjustment during relay production. The example shown is merely representative of forms in which the invention may be practiced and it will be understood that, following the teachings herein, the specific forms of the invention may be varied and modified in accordance with the skill of the art.

I claim:

1. Relay circuitry, for holding an electrically held relay closed with minimized power dissipation, comprising:

a relay coil in a series current path between DC input voltage terminals;

a switching current regulator for permitting an applied DC input voltage to develop current in said coil reaching a level sufficient to close the relay and then to remove applied voltage from said coil during which a current sufficient to hold the relay closed is maintained by the coil inductance and restoring applied voltage to said relay before the coil current drops below the minimum holding current level;

said switching current regulator comprising a gated series voltage regulator for maintaining a regulated voltage on a resistive voltage divider connected to one input of a voltage comparator, a resistive shunt in series with said relay coil connected to apply a coil current indicating voltage to the other input of said comparator, and a first transistor switch in series with said relay coil and responsive to the output of said comparator to turn off said series current path when coil current has reached the closing level and to turn on said series current path when the coil current drops to a level approaching the holding current level.

2. Relay circuitry in accordance with claim 1 wherein:

said switching current regulator further comprising a second transistor switch connected in said series current path and operable when the DC supply voltage is removed to speed up reduction of coil current below the holding level.

* * * * *